US007036607B2

(12) United States Patent
Lebisch et al.

(10) Patent No.: US 7,036,607 B2
(45) Date of Patent: May 2, 2006

(54) ELECTRIC HAND TOOL

(75) Inventors: Helmut Lebisch, Stuttgart (DE); Otto Baumann, Leinfelden-Echterdingen (DE); Siegfried Fehrle, Leinfelden-Echterdingen (DE); Dietmar Saur, Gomaringen (DE); Andre Ullrich, Filderstadt-Bernhausen (DE); Michael Weiss, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/510,023

(22) PCT Filed: Oct. 31, 2003

(86) PCT No.: PCT/DE03/03626

§ 371 (c)(1),
(2), (4) Date: Oct. 1, 2004

(87) PCT Pub. No.: WO2004/085118

PCT Pub. Date: Oct. 7, 2004

(65) Prior Publication Data

US 2005/0126801 A1 Jun. 16, 2005

(30) Foreign Application Priority Data

Mar. 24, 2003 (DE) ..... 103 12 981

(51) Int. Cl.
*B25D 16/00* (2006.01)

(52) U.S. Cl. ..... 173/109; 173/201

(58) Field of Classification Search ..... 173/48, 173/104, 109, 121, 201, 205, 212
See application file for complete search history.

(56) References Cited

U.S. PATENT DOCUMENTS

| | | | | |
|---|---|---|---|---|
| 3,456,740 | A * | 7/1969 | Bronnert et al. | 173/109 |
| 3,874,460 | A * | 4/1975 | Schmid et al. | 173/109 |
| 4,284,148 | A | 8/1981 | Wanner et al. | |
| 4,719,976 | A * | 1/1988 | Bleicher et al. | 173/109 |
| 4,732,217 | A * | 3/1988 | Bleicher et al. | 173/104 |
| 4,895,212 | A * | 1/1990 | Wache | 173/48 |
| 5,775,440 | A * | 7/1998 | Shinma | 173/109 |
| 5,787,996 | A * | 8/1998 | Funfer | 173/104 |
| 5,873,418 | A * | 2/1999 | Arakawa et al. | 173/212 |
| 6,015,017 | A * | 1/2000 | Lauterwald | 173/48 |
| 6,712,156 | B1 * | 3/2004 | Funfer | 173/48 |

FOREIGN PATENT DOCUMENTS

| | | |
|---|---|---|
| CH | 356 396 | 9/1961 |
| DE | 28 20 128 | 11/1979 |
| EP | 0 403 789 | 12/1990 |
| GB | 2 322 675 | 9/1998 |

* cited by examiner

*Primary Examiner*—Scott A. Smith
(74) *Attorney, Agent, or Firm*—Michael J. Striker

(57) ABSTRACT

An electric hand tool is disclosed which has a gt (15), received in a housing (10), with a gear shaft (20) and also has at least one radial bearing (30) for rotary support of the gear shaft (20), the inner bearing ring (301) of the radial bearing being fixed on the gear shaft (20) and the outer bearing ring (302) of the radial bearing being fixed in a bearing box (31) disposed in the housing (10), in each case being fixed axially nondisplaceably. For simple assembly of the gt (15) without tools, the outer bearing ring (302) of the radial bearing (30) rests with a sliding seat in the bearing box (31) and is fixed by means of a clamping bracket (32) fixed to the bearing box (31).

8 Claims, 3 Drawing Sheets

ELECTRIC HAND TOOL

BACKGROUND OF THE INVENTION

The invention relates to an electric hand tool, in particular a jackhammer or a percussion drill.

In a known jackhammer or percussion hammer (German Patent Disclosure DE 28 20 128 A1), the gear shaft, forming part of a layshaft gear, is received rotatably in the housing by means of two ball bearings, which with their inner bearing ring are each shrink-fitted onto one end portion of the gear shaft. The outer bearing ring of the ball bearing is press-fitted in a respective bearing box. One of the bearing boxes is embodied in the housing, and the other of the bearing boxes is embodied in an intermediate flange retained in the housing. Each bearing box has an annular shoulder, on which the outer bearing ring is placed for its positionally correct positioning in the process of press-fitting the ball bearing into the bearing box.

SUMMARY OF THE INVENTION

The electric hand tool of the invention has the advantage that because of the sliding seat, provided according to the invention, of the radial bearing in the bearing box, the gear shaft and radial bearing can be easily assembled and then, by means of the clamping bracket provided according to the invention, can be axially fixed in the housing without tools. An axial stop provided on the bearing box predetermines the positionally correct position. The clamping bracket is an inexpensive component and makes a compact design of the drive gear possible.

By means of the provisions recited in the further claims, advantageous refinements of and improvements to the electric hand tool defined by claim 1 are possible.

In a preferred embodiment of the invention, the clamping bracket is embodied spring-elastically and can be slipped onto the bearing box transversely to the axis of the gear shaft in such a way that it fits over the outer ring of the radial bearing, on one face-end annular face thereof, and the radial bearing is adapted, with its other face-end annular face, to an axial stop embodied on the bearing box. The clamping bracket that is resilient in the axial direction of the gear shaft serves as a lever during assembly and with a high axial clamping force it makes an only slight assembly force possible, since the high clamping force is attained only just before the final position of the clamping bracket is reached. For this purpose, in an advantageous embodiment of the invention, the clamping bracket has two spring-elastic bracket arms, which can be inserted axially nondisplaceably by their free end portions into two first counterpart bearings embodied on the bearing box, and also has a transverse part integrally joining the two bracket arms at the other ends of the arms; this transverse part is axially nondisplaceably fixable in a second counterpart bearing, embodied on the bearing box.

To generate a high clamping force, in an advantageous embodiment of the invention, the bracket arms are embodied as flat and in at least one arm portion are provided with a bulge oriented transversely to the plane of the bracket arms.

In an alternative embodiment of the invention, the bracket arms extend parallel to one another and each have one longitudinally extending guide rib. The guide ribs can be inserted into longitudinal grooves that extend parallel to one another and are diametrically opposite one another on the bearing box and extend transversely to the bearing axis.

BRIEF DESCRIPTION OF THE DRAWINGS

The invention is described in further detail in the following description, in terms of exemplary embodiments shown in the drawing. Shown are.

DETAILED DESCRIPTION OF THE PREFERRED EMBODIMENTS

Figure 1:
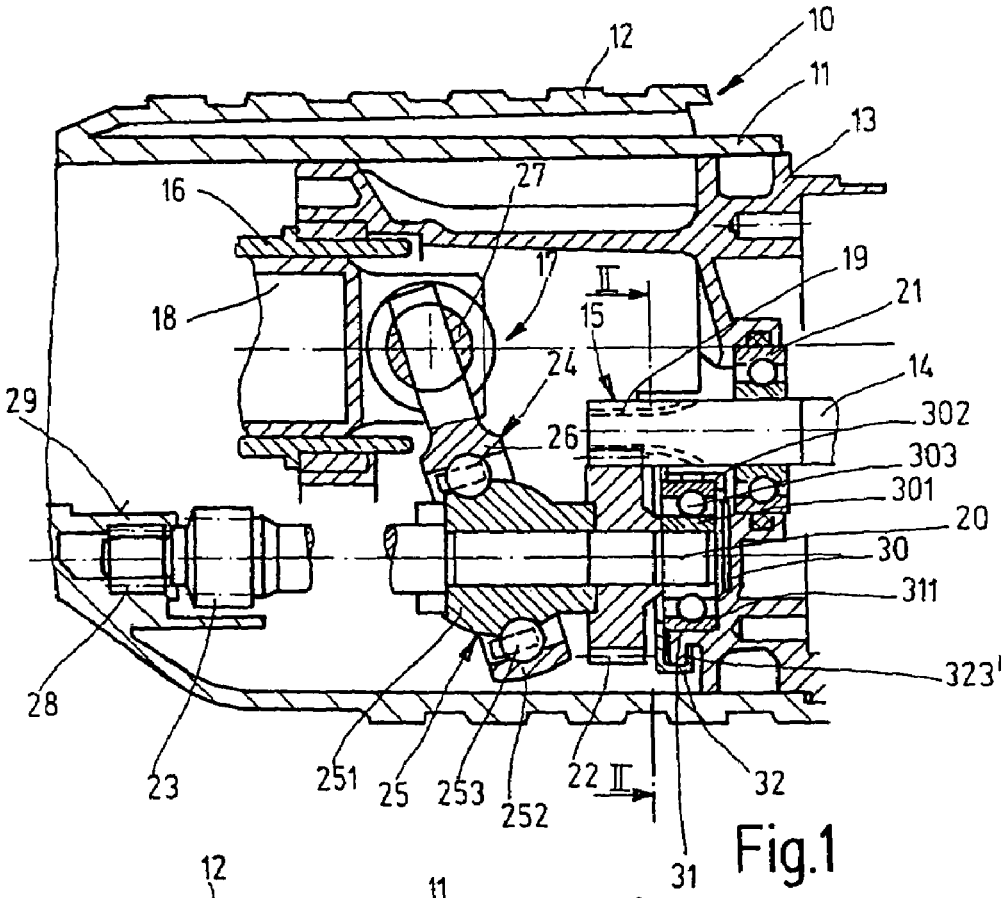
FIG. 1, a detail of a longitudinal section through a jackhammer.

The jackhammer, shown in fragmentary form in longitudinal section in FIG. 1, as an exemplary embodiment for an electric hand tool in general, has a housing 10 with an inner housing shell 11 and an outer housing shell 12 as well as an intermediate flange 13. An electric motor is received with its power takeoff shaft 14 in the interior of the housing 10 in a known manner and via a drive gear 15, it drives a rotary sleeve 16 to rotate and drives a percussion mechanism 17 translationally. Although not further shown, the rotary sleeve 16 is coupled with a tool receptacle, in which a tool such as a percussion drill, is fastened; this drill is carried along in the direction of rotation of the tool receptacle and is capable in the tool receptacle of executing a limited reciprocating displacement motion. The percussion mechanism 17 has a reciprocating drive piston 18, guided axially displaceably in the rotary sleeve 16, and a beater, not shown here, which can be acted upon by the drive piston 18 via an air cushion, and which outputs its impact energy to the tool retained in the tool receptacle. A complete illustration and description of the tool receptacle with the tool and the percussion mechanism 17 are found in DE 28 20 128 A1.

Both the rotary pivoting motion of the rotary sleeve 16 and the translational motion of the drive piston 18 are derived from the power takeoff shaft 14 of the electric motor by means of an intermediate shaft 20. To that end, on the power takeoff shaft 14, a drive pinion 19 is embodied, which meshes with a gear wheel, in this case an intermediate gear wheel 22, that is press-fitted onto the intermediate shaft 20. The power takeoff shaft 14 is received, with its wave portion directly adjacent the drive pinion 19, in a ball bearing 21, which is fixed in the intermediate flange 13. The intermediate shaft 20 supports a layshaft pinion 23 in a manner fixed against relative rotation, and this pinion meshes with a layshaft gear wheel, not shown, which in turn engages a ring gear embodied on the rotary sleeve 16.

Figure 2:
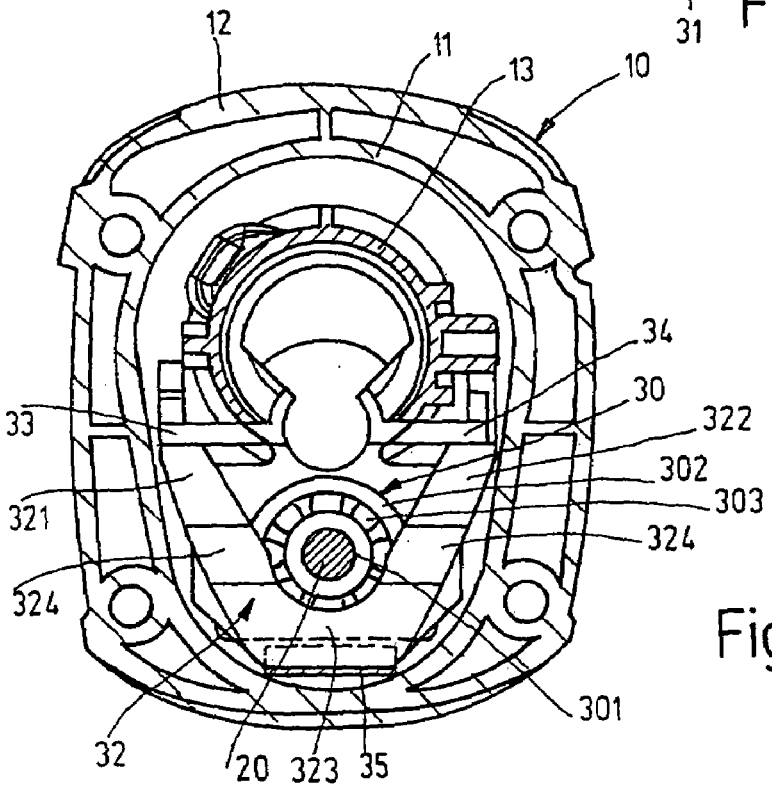
FIG. 2, a section taken along the line II—II in FIG. 1.
Figure 3:
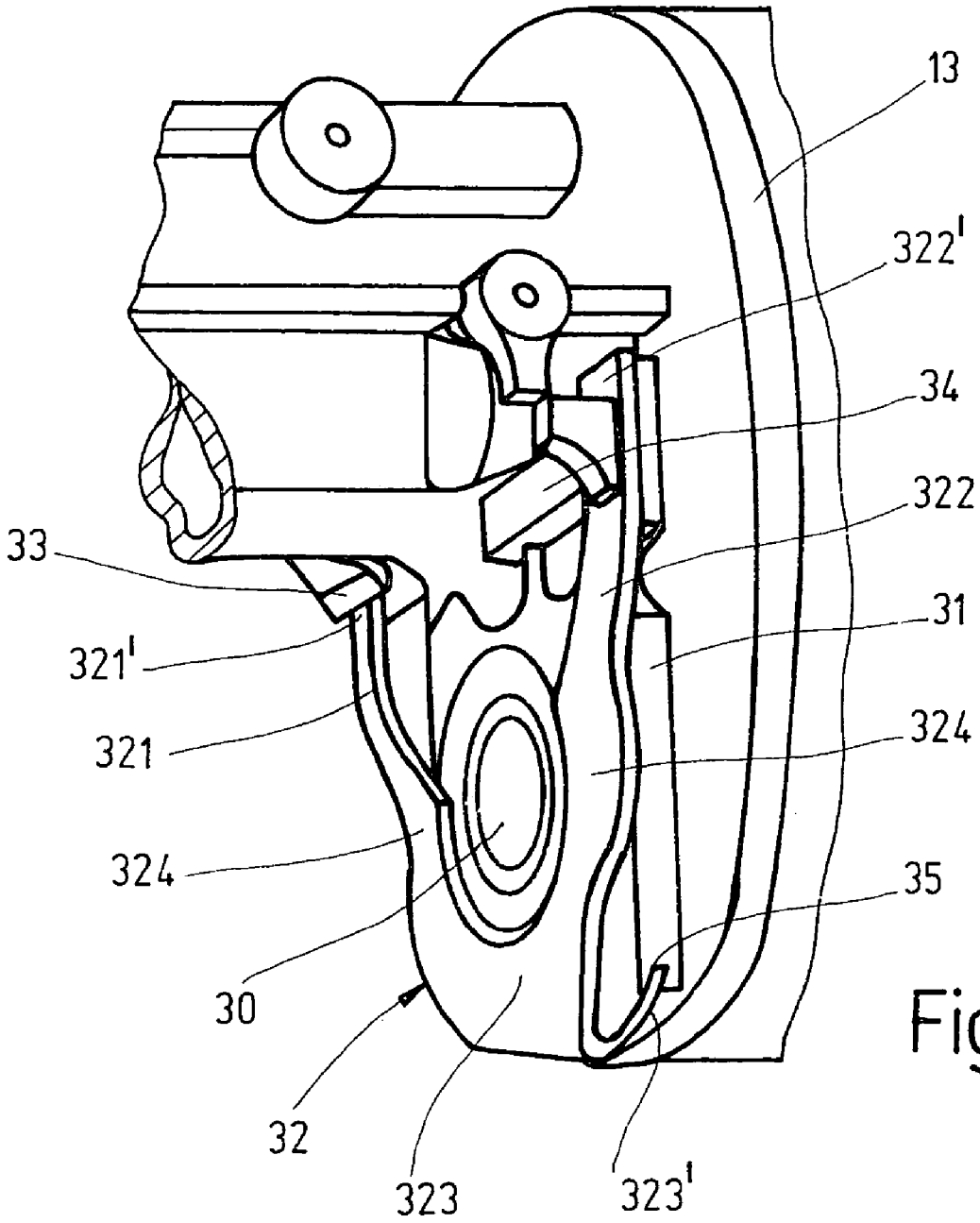
FIG. 3, a fragmentary perspective plan view on the clamping bracket and intermediate flange of the jackhammer in FIG. 1.

The percussion mechanism 17 is driven by the intermediate shaft 20 via a pendulum gear 24. In the exemplary embodiment shown, the pendulum gear 24, which is known per se, has a drive bearing 25, embodied as a ball bearing, which is either seated in a manner fixed against relative rotation on the intermediate shaft 20 or is loosely slipped onto it and can then be connected by means of a coupling to the intermediate shaft 20 for the sake of taking over rotation. The drive bearing 25, comprising an inner bearing body 251 and an outer bearing ring 252 with balls 253 disposed between them is placed with its inner bearing body 252 on the intermediate shaft 20 and is embodied such that the bearing axis forms an acute angle with the axis of the intermediate shaft 20. The outer bearing ring 252 of the drive bearing 25 supports a radially protruding slaving bolt 26, which with play engages a qb of a pivot bolt 27. The pivot bolt 27 is retained in a bifurcated end of the drive piston 18. The intermediate shaft 20 is rotatably supported in the housing 10 by means of two radial bearings. The radial bearing 28 shown on the left in FIG. 1 is embodied as a needle bearing, which is received in a corresponding bearing receptacle 29 of the housing 10. The radial bearing 30, which has an inner bearing ring 301 and an outer bearing ring 302 with balls 303 retained between them, is press-fitted with its inner bearing ring 301 onto the intermediate shaft 20 and rests with its outer bearing ring 302 in a sliding seat in a bearing box 31 embodied in and integrally with the intermediate flange 13 and is retained axially nondisplaceably in the bearing box 31 by means of a clamping bracket 32 that is fixed to the bearing box 31 or the intermediate flange 13. The clamping bracket 32, embodied spring-elastically, is slipped—as can be seen in FIGS. 1–3—onto the bearing box 31 or the intermediate flange 13 transversely to the axis of the intermediate shaft 20; the clamping bracket 32 fits over the outer bearing ring 302 on one face-end annular face and presses with its other face-end annular face against an annular shoulder 311 embodied on the bearing box 31 and acting as an axial stop. The clamping bracket 32, which can be seen in plan view in FIG. 2 and in perspective in FIG. 3, has two spring-elastic bracket arms 321, 322, which on one end of the arms are joined on one end of the arms by a transverse part 323 that is integral with them. The bracket arms 321, 322 are embodied as flat, and to increase their clamping force, they each, in an arm portion, have one bulge 324 oriented transversely to the plane of the bracket arms. The bracket arms 321, 322 extend at an acute angle to one another approximately in a V, while their free end portions 321', 322' are oriented parallel to one another. The transverse part 323 is bent twice toward the underside on its transverse edge, forming a "U", whose leg located at the bottom forms a rear-engagement rib 323' that is integral with the transverse part 323.

For firmly fastening the clamping bracket 32 to the bearing box 31 or to the intermediate flange 13, two slotlike first counterpart bearings 33, 34 and one second counterpart bearing 35 embodied as an undercut are embodied on the bearing box 31 and the intermediate flange 13, respectively. In the process of slipping the clamping bracket 32 onto the intermediate flange 13, the free end portions 321' and 322' are each slipped into a respective one of the first counterpart bearings 33, 34, and the first counterpart bearings 33, 34 axially nondisplaceably fix the bracket arms 321, 322. The clamping bracket 32 is then slipped on far enough that the rear-engagement rib 323', embodied on the transverse part 323, is located immediately in front of the second counterpart bearing 35 on the underside of the bearing box 31. The clamping bracket 32 is then pressed onto the bearing box 31 counter to the spring force of the bulges 324 and is displaced farther, until the rear-engagement rib 323' engages the undercut of the second counterpart bearing 35 from behind (FIGS. 1 and 3).

Figure 4:
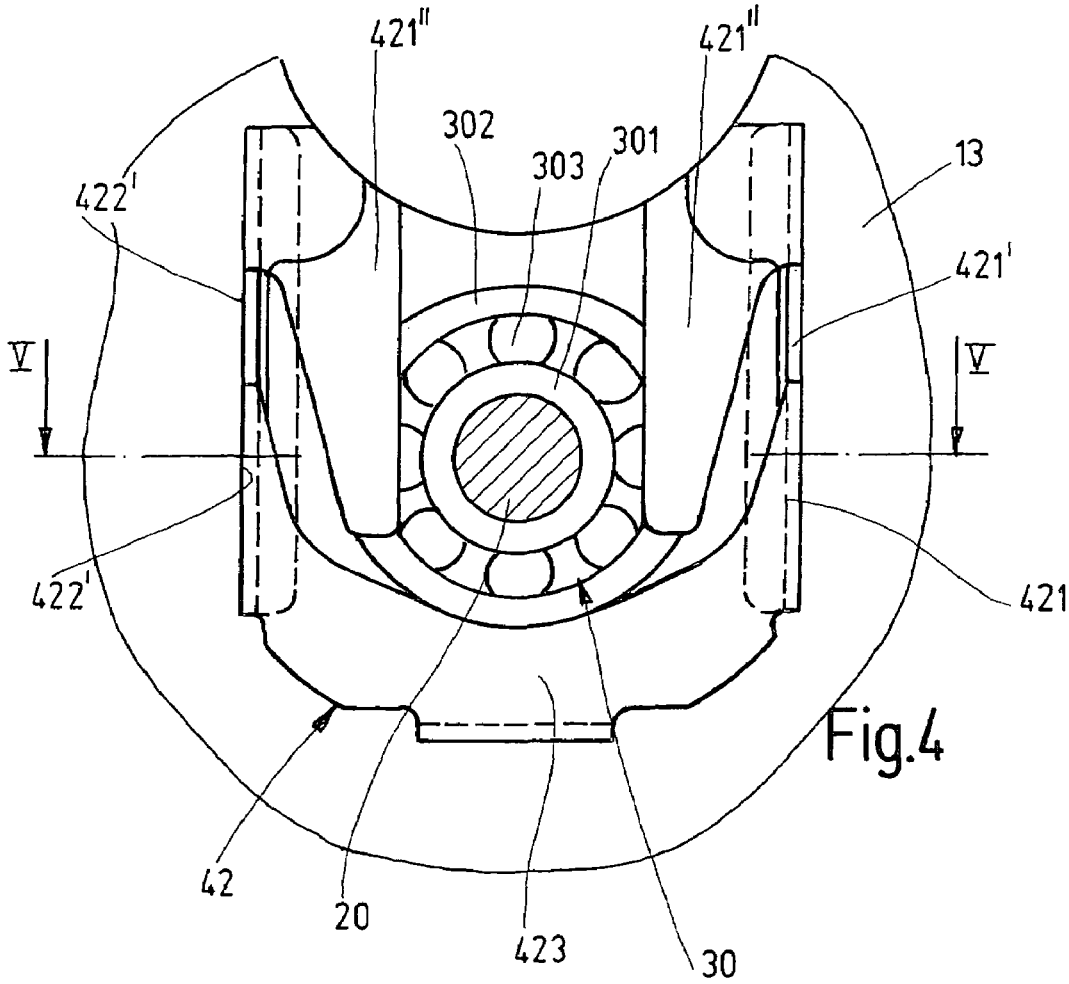
FIG. 4, a detail of a plan view of a modified intermediate flange of the jackhammer of FIG. 1, with a modified clamping bracket slipped onto it.
Figure 5:
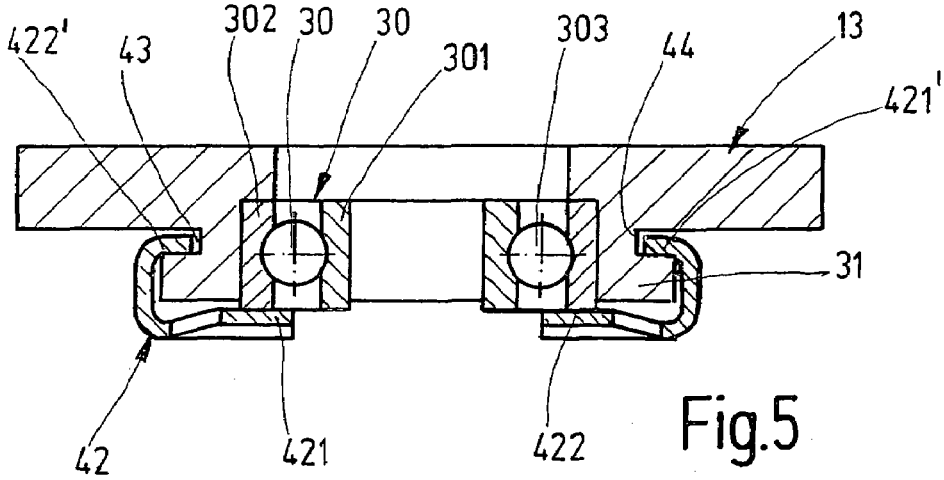
FIG. 5, a section taken along the line V—V in FIG. 4.

In FIGS. 4 and 5, a modified clamping bracket 42 is shown, for fixing the radial bearing 30 in the bearing box 31 of the intermediate flange 13. The clamping bracket 42, once again embodied spring-elastically, has two spring-elastic bracket arms 421, 422, which on one end of the arms are integrally joined by means of a transverse part 423. The bracket arms 421, 422 extend parallel to one another, and each arm has both a respective guide rib 421' and 422', formed by bending their longitudinal edges into a U and extending parallel to the longitudinal axis of the clamping bracket 42, and an inward-protruding, wide spring arm 421" and 422", which are prestressed transversely to the plane of the clamping bracket.

The embodiment of the bearing box 31 in the intermediate flange 13 is modified such that instead of the counterpart bearings on the bearing box 31, two parallel longitudinal grooves 43, 44 (FIG. 5), diametrically opposite the axis of the intermediate shaft 20, are provided, into which the bracket arms 421, 422 can be inserted with their guide ribs 421', 422'. If the clamping bracket 42 is inserted with its bracket arms 421, 422 into these longitudinal grooves 43, 44, the spring arms 421" and 422" press axially against the outer bearing ring 302 of the radial bearing 30 and press the radial bearing 30 against the annular shoulder 311, embodied on the bearing box 31, in the same way as in FIG. 1.

The invention is not limited to the jackhammer described. It can be employed in any electric hand tool in which a gear shaft is rotatably supported by means of a radial bearing, such as power drills, power saws, power planes, and the like.

The invention claimed is:

1. An electric hand tool, having a drive gear (15), which is received in a housing (10) and has a gear shaft (20), and having at least one radial bearing (30), which has one inner and one outer bearing ring (301, 302), for rotary support of the gear shaft (20), whose inner bearing ring (301) is fixed on the gear shaft (20) and whose outer bearing ring (302) is fixed in a bearing box (31) embodied in the housing (10), in each case being fixed axially nondisplaceably, characterized in that the outer bearing ring (302) rests with a sliding seat in the bearing box (31), and fixation of the outer bearing ring in the bearing box (31) is performed by means of a clamping bracket (32; 42) that is fixable to the bearing box (31), wherein the clamping bracket (32; 42) is spring-elastic and is capable of being shipped onto the bearing box (31) transversely to the axis of the gear shaft (20) in such a way the clamping bracket fits over the outer bearing ring (302) of the radial bearing (30) on one annular end face thereof, and the radial bearing is pressed with its other annular end face against an axial stop (311) formed on the bearing box (31), wherein the clamping bracket (32; 42) has two spring-elastic bracket arms (321, 322) and one transverse part (323), integrally connecting the bracket arms (321, 322) on one arm end, wherein two first counterpart bearings (33, 34) are provided on the bearing box (31) for axially nondisplaceable fixation of the free end portions (321', 322') of the bracket arms (321, 322), and a second counterpart bearing (35) is provided for axially nondisplaceable fixation of the transverse part (323).

2. The tool of claim 1, wherein the bracket arms (321, 322) are flat and, in at least one arm portion, have a bulge (324) that bulges outward transversely to a plane of the bracket arms.

3. The tool of claim 2, wherein flat end portions (321', 322') of the bracket arms (321, 322) are each insertable in a respective one of the first counterpart bearings (33, 34), wherein the first counterpart bearings have a slotlike form.

4. The tool of claim 1, wherein the second counterpart bearing (35) is formed by an undercut in the bearing box (31) that is engaged by a rear-engagement rib (323'), extending peripherally on the transverse part (323); and wherein the rear-engagement rib (323') is formed by bending a longitudinal edge of the transverse part (323) into a U.

5. The tool of claim 1, wherein the bracket arms (321, 322) extend at an acute angle to one another approximately in a V; and wherein free end portions (321', 322') of the bracket arms (321, 322) that are insertable into the first counterpart bearings (33, 34) are oriented parallel to one another.

6. An electric hand tool, having a drive gear (15), which is received in a housing (10) and has a gear shaft (20), and having at least one radial bearing (30), which has one inner and one outer bearing ring (301, 302), for rotary support of the gear shaft (20), whose inner bearing ring (301) is fixed on the gear shaft (20) and whose outer bearing ring (302) is fixed in a bearing box (31) embodied in the housing (10), in each case being fixed axially nondisplaceably, characterized in that the outer bearing ring (302) rests with a sliding seat in the bearing box (31), and fixation of the outer bearing ring in the bearing box (31) is performed by means of a clamping bracket (32; 42) that is fixable to the bearing box (31), wherein the clamping bracket (32; 42) is spring-elastic and is capable of being slipped onto the bearing box (31) transversely to the axis of the gear shaft (20) in such a way the clamping bracket fits over the outer bearing ring (302) of the radial bearing (30) on one annular end face thereof, and the radial bearing is pressed with its other annular end face against an axial stop (311) formed on the bearing box (31), wherein the clamping bracket (42) has two spring-elastic bracket arms (421, 422) and one transverse part (423) integrally joining the bracket arms (421, 422) at one end of the arms; wherein guide ribs (421', 422') extending longitudinally are formed on the bracket arms (421, 422); and wherein in the bearing box (31), diametrically opposed longitudinal grooves (43, 44) are formed, extending transversely to a bearing axis and parallel to one another, wherein the guide ribs (421', 422') are insertable into the grooves.

7. The tool of claim 6, wherein the guide ribs (421', 422') are formed by bending the bracket arms (421, 422) into a U on longitudinal edges of the bracket arms.

8. The tool of claim 6, characterized in that wherein the bracket arms (421, 422), on sides facing one another, have protruding spring arms (421", 422"), with a spring prestressing acting transversely to a plane of the clamping bracket (42).

* * * * *